United States Patent [19]

Hernandez et al.

[11] 4,308,650

[45] Jan. 5, 1982

[54] METHOD OF MAKING A MERCURY DISPENSER, GETTER AND SHIELD ASSEMBLY FOR A FLUORESCENT LAMP

[75] Inventors: Rafael J. Hernandez, Peabody; Thomas S. Yong, Danvers; Tadius T. Sadoski, Salem, all of Mass.

[73] Assignee: GTE Products Corporation, Stamford, Conn.

[21] Appl. No.: 107,984

[22] Filed: Dec. 28, 1979

[51] Int. Cl.[3] ..... H01J 9/00; H01J 61/26; H01J 61/28

[52] U.S. Cl. ..... 29/25.13; 313/174; 313/490; 313/492; 313/42

[58] Field of Search ..... 313/174, 490, 178, 492, 313/42, 226; 29/25.13 (U.S. only)

[56] References Cited

U.S. PATENT DOCUMENTS

| | | | |
|---|---|---|---|
| 2,714,684 | 8/1955 | Meister et al. | 313/484 X |
| 3,215,882 | 11/1965 | Toomey | 313/492 X |
| 3,544,829 | 12/1970 | Someya et al. | 313/490 X |
| 3,898,511 | 8/1975 | Johnson et al. | 313/490 |
| 4,032,813 | 6/1977 | Shurgan et al. | 313/492 |
| 4,056,750 | 11/1977 | Latassa | 313/174 X |

*Primary Examiner*—Palmer C. Demeo
*Attorney, Agent, or Firm*—William H. McNeill

[57] ABSTRACT

A fluorescent lamp operating on reduced energy consumption includes a unique mount which carries a shield providing both a getter and a mercury dispenser. The lamp has a preferable fill of 80% neon and 20% krypton at a pressure of 2.0 Torr.

2 Claims, 5 Drawing Figures

METHOD OF MAKING A MERCURY DISPENSER, GETTER AND SHIELD ASSEMBLY FOR A FLUORESCENT LAMP

TECHNICAL FIELD

This invention relates to fluorescent lamps having reduced energy comsumption and more particularly to such lamps employing a novel getter, mercury dispenser and shield. Also disclosed is a method of making a shield employing a getter and mercury dispenser.

BACKGROUND ART

Electric discharge lamps of the type utilizing an electric discharge in a gas at low pressure in the presence of a low pressure of mercury are well known. Fluorescent lamps are a type of such discharge lamps wherein an energizable phosphor is included in the lamp.

Very high output (VHO) fluorescent lamps employing one or more heat shields for creating a cool region at one or both ends of the lamps are also known. U.S. Pat. No. 3,898,511 discloses such a heat shield and, furthermore, suggests applying an amalgam forming material to the heat shield. Such lamps have also included a separate getter structure for removing contaminating materials generated by operation of the lamp. The separate getter usually required an additional supporting structure within the lamp and increased the cost of manufacture. Also, such tubes have often employed disintegration shields of the type shown in U.S. Pat. No. 4,056,750, which also required an extra support wire.

DISCLOSURE OF THE INVENTION

It is, therefore, an object of the invention to obviate the disadvantages of the prior art.

It is another object of the invention to enhance fluorescent lamps.

These objects are accomplished in one aspect of the invention by the provision, in an electric discharge lamp, of a shield which includes on one side thereof a mercury dispensing material and on the other side thereof a getter material. The shield is transversely mounted in the lamp between the cathode and the end of the lamp. The getter material faces the cathode.

In high current fluorescent lamps the shield can be substantially imperforate and also function as a heat shield is not required, the shield can be perforated and function merely as a supporting substrate for the mercury dispensing material and the getter. The shield thus has wide applicability in lamp manufacture, and additional supports are eliminated, further reducing costs. In one embodiment with a particular combination of fill gases, a pair of such lamps employing a commercial ballast achieves an energy or power reduction of 10.5% with only a 6.7% reduction in light output.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
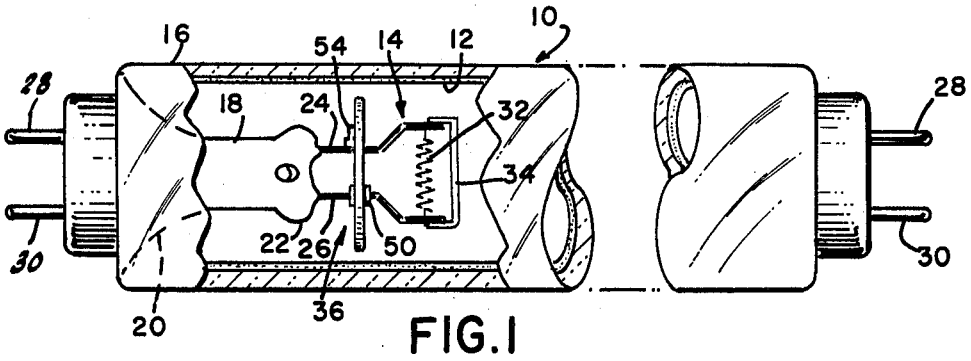
FIG. 1 is an elevational view, partially in section, illustrating an electric discharge lamp employing a shield.

Referring now to the drawings with greater particularity, there is shown in FIG. 1 a fluorescent lamp comprising a tubular glass envelope 10 having the customary phosphor coating 12 on its inner surface and at least one electrode mount 14 sealed into an end 16. The envelope 10, which is light transmitting, is filled with a rare gas such as argon, krypton, neon, etc. In the preferred embodiment of this invention the gas is a mixture of from about 75% to 90% neon and 25% to 10% krypton. Within this range a mixture of about 80% neon and 20% krypton is preferred. The gas should be at low pressure; i.e., 1.5 Torr to 2.5 Torr with 2 Torr being preferred.

The mount structure 14 includes a reentrant vitreous stem 18 having at one end a flared portion 20, which is sealed about its periphery to the end 16 of envelope 10, and a press 22 at the other end thereof. A pair of lead-in wires 24 and 26 are sealed into press 22 and terminate outside the envelope in terminal pins 28 and 30. Interiorly of envelope 10 the lead-in wires 24 and 26 support a cathode 32 therebetween. One or more auxiliary electrodes 34 may be attached when the lamp is operated by alternating current, as is well known in the art.

Mount 14 also includes a shield 36 which in high current fluorescent lamps can function as a heat shield. While in this instance the shield is shown as being attached to one of the lead-in wires, it will be understood that it can be operatively positioned anywhere between the cathode 32 and the end 16 of envelope 10.

Figure 2:
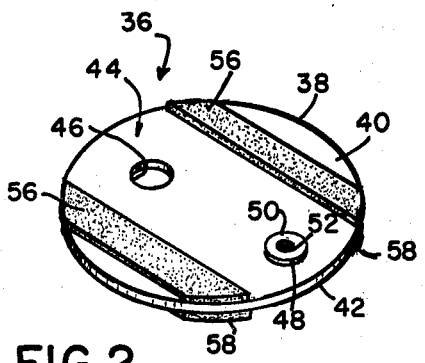
FIG. 2 is a perspective view of an embodiment of the invention.

The novel shield 36 is shown more clearly in FIG. 2 and comprises and electrically conductive disc 38 of a suitable material such as iron, nickel, stainless steel, nickel plated iron, etc. Disc 38 has a first surface 40 and an opposite surface 42 and includes therein mounting means 44. When it is desired to mount shield 36 from the lead-in wires, the mounting means 44 comprises a pair of apertures 46 and 48 having diameters larger than the diameters of the lead-in wires. One of the apertures, e.g., 48, is fitted with a ceramic button 50 which contains an aperture 52 through which one of the lead-in wires can pass. The other lead-in wire passes through the other aperture, 46 in this instance. Mechanical connection and support for the shield 36 can be supplied by an "L" shaped tab 54 (FIG. 1) which has one leg welded to the lead-in wire and the other leg welded to the shield 36. Alternatively, aperture 46 can be formed by a punching operation which leaves the removed material attached to disc 38 at one side of the aperture, this material being welded to a lead-in wire.

Whichever manner of support is utilized, disc 38 has on first surface 40 at least one strip or area of a getter material 56 and on the opposite surface 42 at least one strip or area of a mercury dispensing material 58.

The getter material can be compound or mixture of titanium, zirconium and aluminum and the mercury dispensing material can be a mixture or compound of titanium and mercury or some other suitable mercury compounds, such materials being known in the art, and they can be applied thereto in any known manner.

When shield 36 is mounted in envelope 10, first surface 40 faces the cathode 32.

Figure 3:
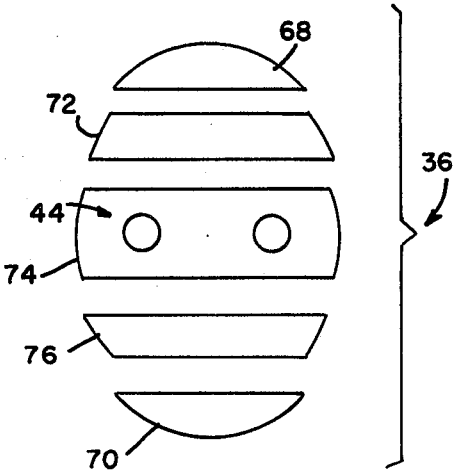
FIG. 3 is a plan view of one step in the manufacture of an embodiment of the invention.
Figure 4:
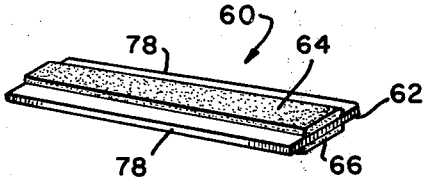
FIG. 4 is a perspective view of a material that can be employed with the invention.

Referring now to FIGS. 3 and 4, a novel method of making shield 36 employs a commercially available getter-mercury dispenser strip 60. Strip 60 comprises a substrate 62 of, e.g., nickel plated iron, having on one side thereof a getter material 64 and on an opposite side thereof a mercury dispenser 66. Such material is available from S.A.E.S. Getters S.p.a., Milan, Italy, and has been employed in fluorescent lamps as a disintegration shield. This latter use requires an extra support wire in the press and, furthermore, the disintegration shield surrounds the cathode and introduces objectionable shadowing effects.

Figure 5:
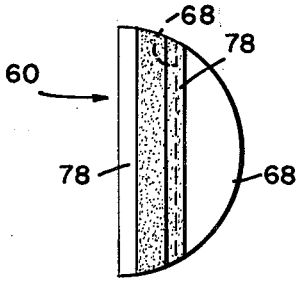
FIG. 5 is a partial plan view of another step in the manufacture of the invention.

As can be seen in FIG. 3, a shield 36 is cut or otherwise separated into a plurality of segments including two end segments 68 and 70 and at least one internal segment. In the embodiment shown three internal segments 72, 74, and 76 are formed. The central segment 74 contains mounting means 44. Segments 72 and 76 are removed and replaced with appropriately shaped segments of strip 60. The shield is then re-assembled by welding, cementing or otherwise rejoining thesegments as shown in FIG. 5, the selvage edges 78 of strips 60 being employed for this purpose.

Thus, employment of this unique mount results in many improvements over the prior art. The mercury supply and the getter are ideally located within the lamp to perform their respective functions and are economically activated by inductive or RF heating after the lamp is sealed. The support for these materials provides an excellent heat shield in high current lamps to insure a cool zone for the mercury. In low current applications where the function of heat shielding is not required, the shield 36 can be slotted or otherwise perforated, thus increasing the usability of the device and achieving further cost savings in manufacture. Additional supports for a separate getter mount are eliminated, as well as the need for a disintegration shield which causes unwanted shadowing of the cathode.

Furthermore, inclusion of this unique mount in a lamp with the above-described neon-krypton gas fill provides reduced power consumption and increased lamp efficacy. Thus, a conventional 8 foot T12 VHO lamp in Cool White color employing commercial ballast and a neon-argon fill operates at 215 watts and 15000 lumens, giving a lamp efficacy of 69.8 lumens per watt.

In contradistinction, the lamp of this invention, in the same circuit and employing the same ballast, consumes 195 watts and has a light output of 14000 lumens giving a lamp efficacy of 71.8 lumens per watt. While the lamp of the invention suffers a 6.7% reduction in light output as compared to the standard described above, it also provides a desirable and unexpected 9.3% reduction in energy consumed. When operated in a two lamp commercial ballast, power reduction is 10.5%.

There is thus provided by this invention a fluorescent lamp having a new and novel mount construction and reduced energy consumption which can be used in existing fixtures.

While there have been shown and described what are at present considered to be the preferred embodiments of the invention, it will be apparent to those skilled in the art that various changes and modifications can be made herein without departing from the scope of the invention as defined by the appended claims.

We claim:

1. In a method of making a combination mercury dispenser, getter and shield for a fluorescent lamp, the steps comprising: forming a metallic member having a configuration compatible with the interior configuration of said lamp; cutting said member into a plurality of segments including two end segments and at least one internal segment; replacing said at least one internal segment with a coated segment comprising a strip of electrically conductive material having a configuration substantially matching said internal segment and having on one side thereof a mercury dispensing material and on the opposite side thereof a getter material; and attaching said end segments and said coated segments to form an integral shield.

2. The method of claim 1 wherein said attachment takes place by welding.

* * * * *